US007309291B1

(12) United States Patent
Bryant et al.

(10) Patent No.: US 7,309,291 B1
(45) Date of Patent: Dec. 18, 2007

(54) GOLF CLUB HEAD WITH ALIGNMENT INDICIA

(75) Inventors: Leslie J. Bryant, Peoria, AZ (US); Gregory J. Schmidt, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 14 days.

(21) Appl. No.: 11/444,041

(22) Filed: May 31, 2006

(51) Int. Cl.
*A63B 69/36* (2006.01)

(52) U.S. Cl. ..... 473/249; 473/251; 273/DIG. 14

(58) Field of Classification Search ..... 473/219–255, 473/324–350; 273/DIG. 14; D21/736–746
See application file for complete search history.

(56) References Cited

U.S. PATENT DOCUMENTS

| | | | | | |
|---|---|---|---|---|---|
| 3,019,022 | A * | 1/1962 | Ehmke | 473/240 |
| 3,134,596 | A * | 5/1964 | Boznos | 473/250 |
| 3,866,922 | A * | 2/1975 | Marci et al. | 473/250 |
| 4,139,198 | A * | 2/1979 | Kanavas | 473/236 |
| 4,411,430 | A * | 10/1983 | Dian | 473/337 |
| 4,659,083 | A | 4/1987 | Szczepanski | |
| 4,688,798 | A | 8/1987 | Pelz | |
| 4,714,252 | A * | 12/1987 | Roraback | 473/338 |
| 4,749,196 | A * | 6/1988 | Podgor | 473/250 |
| 4,776,594 | A * | 10/1988 | Rango | 473/249 |
| 5,467,538 | A * | 11/1995 | Chou et al. | 33/508 |
| 5,605,510 | A * | 2/1997 | Schmidt et al. | 473/251 |
| 5,839,974 | A * | 11/1998 | McAllister | 473/337 |
| 5,961,392 | A * | 10/1999 | Hillock et al. | 473/236 |
| 5,964,669 | A * | 10/1999 | Bloomer | 473/250 |
| 6,244,972 | B1 * | 6/2001 | Drossos | 473/224 |
| 6,780,119 | B1 * | 8/2004 | Gankas | 473/236 |
| 6,821,212 | B2 * | 11/2004 | Fowler et al. | 473/236 |
| 6,837,801 | B1 | 1/2005 | Souza et al. | |
| 6,905,420 | B2 | 6/2005 | Tang et al. | |
| 6,988,955 | B2 | 1/2006 | Stoakes | |
| 2004/0147332 | A1 * | 7/2004 | Engdahl | 473/236 |

* cited by examiner

*Primary Examiner*—Sebastiano Passaniti
(74) *Attorney, Agent, or Firm*—Darrell F. Marquette

(57) ABSTRACT

A golf club head includes a body and ball alignment indicia that protrudes forwardly of the front surface of the body. A transparent plate covers the ball alignment indicia and has a front face arranged for impacting a golf ball. A flange on the transparent plate is received in a recess in the body thereby forming a mechanical interlock between the transparent plate and the body. The ball alignment indicia has a partial spheroid shape and is located intermediate heel and toe ends of the body.

10 Claims, 2 Drawing Sheets

GOLF CLUB HEAD WITH ALIGNMENT INDICIA

BACKGROUND OF THE INVENTION

The present invention relates to golf clubs and, in particular, to a golf club head with alignment indicia.

It is generally accepted in the golf industry that use of alignment indicia on putter heads assists the golfer in properly aligning the putter head with a golf ball. One example of a prior art putter head with an alignment indicia is disclosed in U.S. Pat. No. 4,688,798 to Pelz. The Pelz patent discloses a putter head with alignment indicia in the form of a row of 2, 3, 4, or 5 golf ball shaped indicators aligned perpendicular to and behind the putter head.

Another example of a prior art putter head with alignment indicia is U.S. Pat. No. 4,659,083 to Szczepanski. The Szczepanski patent discloses a putter head with a group of lines that converge toward the putter head face so that extensions of these lines meet at a point forward of the putter head face.

U.S. Pat. No. 6,905,420 to Tang et al. discloses a putter head similar to that disclosed by the Pelz patent but with only two circular indicia. U.S. Pat. No. 6,988,955 to Stoakes discloses a putter head with a removable cap having alignment indicia including arrowheads, lines, and circles.

SUMMARY OF THE INVENTION

The present invention provides a golf club head including a body having a heel end, a toe end and a front surface. Ball alignment indicia is attached to the body and extends forwardly of the front surface of the body. A transparent plate is mounted on the body enclosing the ball alignment indicia between the body and the transparent plate. The transparent plate has a front face arranged for impacting a golf ball. The ball alignment indicia is located intermediate the heel and toe ends of the body and has a partial spheroid shape. In the preferred embodiment of the present invention, a flange on the transparent plate is received in a recess in the body thereby forming a mechanical interlock between the transparent plate and the body.

DESCRIPTION OF THE INVENTION

Figure 1:
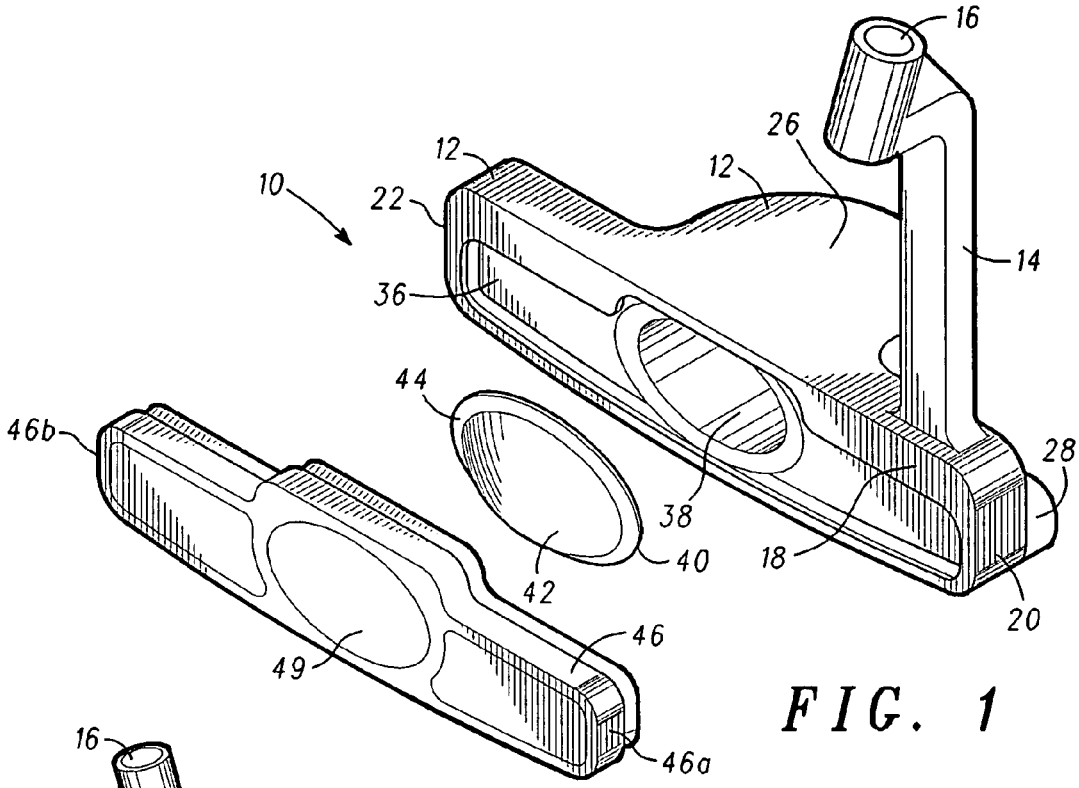
FIG. 1 is an exploded perspective view of a golf club head incorporating the present invention.
Figure 2:
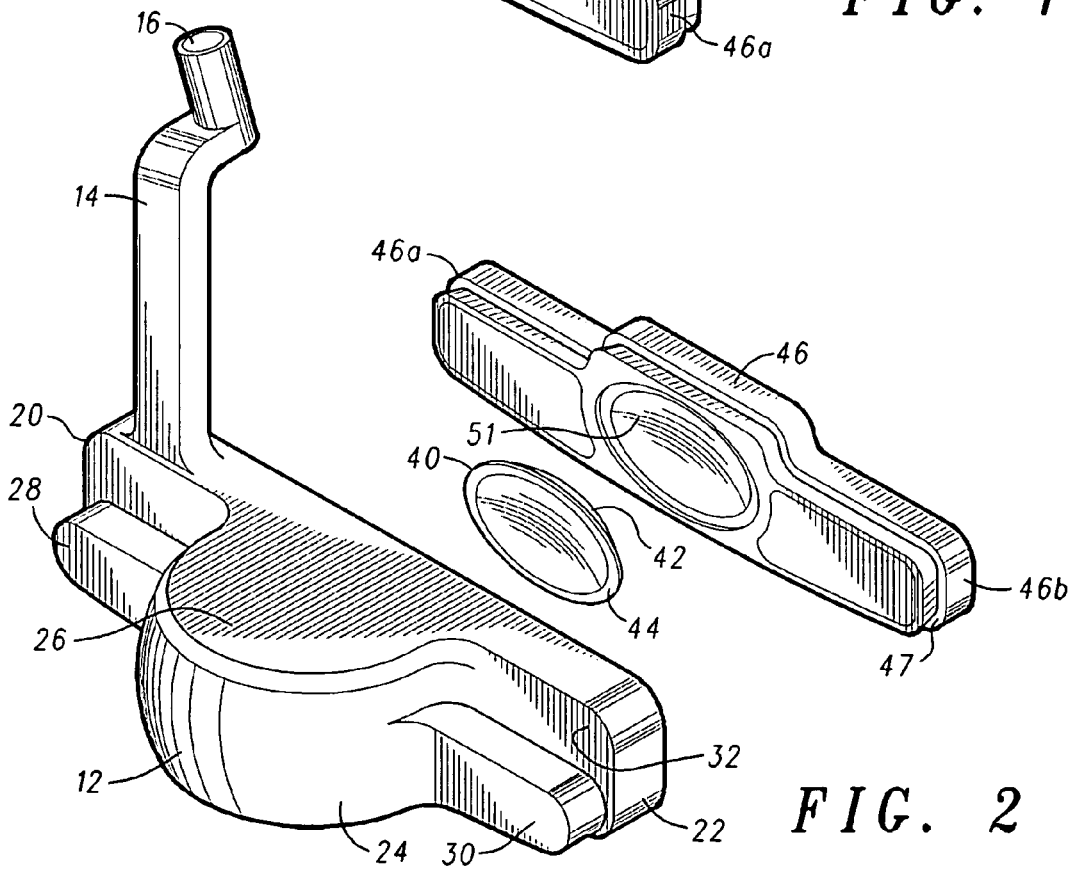
FIG. 2 is another exploded perspective view of the golf club head shown in FIG. 1.
Figure 3:
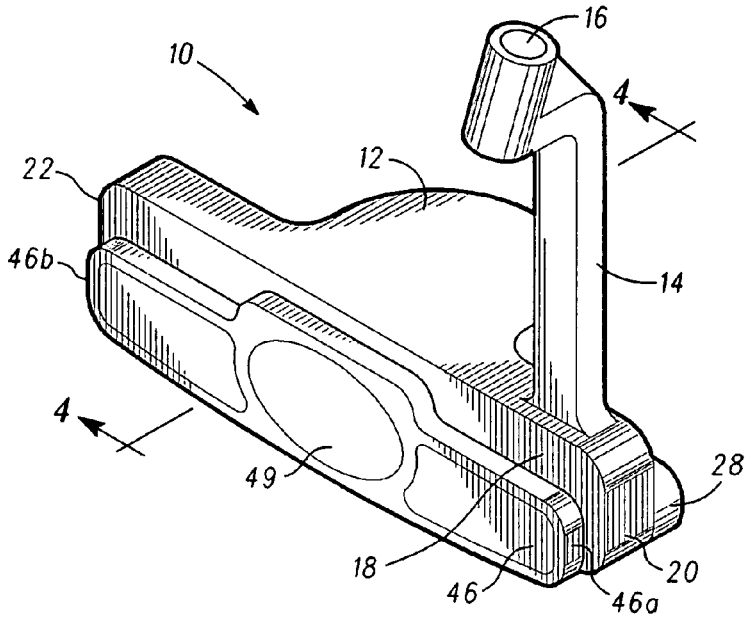
FIG. 3 is a perspective view of the assembled golf club head shown in FIG. 1.

With reference to FIGS. 1-3, a golf club head 10, preferably a golf putter head, includes a body 12 and a hosel 14 with a boss 16 counterbored for receiving a lower end of a golf club shaft (not shown). The body 12 has a front surface 18, a heel end 20 and a toe end 22. Preferably body 12 is cast or machined from a single piece of metallic material such as stainless steel or bronze. Body 12 is preferably formed so that a rear portion 24 thereof is shaped as an oblate partial spheroid having a spherical diameter such that its upper surface 26 thereof has a circular diameter approximately equal to the spherical diameter of a golf ball. A heel weight 28 and a toe weight 30 extend rearward from back surface 32 of body 12.

Body 12 has an elongated cavity 36 extending rearward from front surface 18, and a partial spheroid shaped cavity 38 extends rearward from the elongated cavity 36. Partial spheroid shaped cavity 38 is closed by ball alignment indicia 40 which has a partial spheroid shape 42 surrounded by a mounting flange 44. The partial spheroid shape 42 of the ball alignment indicia 40 protrudes forwardly of the front surface 18 of the body 12. Ball alignment indicia 40 is attached to body 12 and is located intermediate the heel and toe ends 20, 22 of body 12.

A transparent plate 46 covers ball alignment indicia 40 to form the assembled club head 10 shown in FIG. 3. The transparent plate 46 is mounted on body 12 with its rear surface 47 contacting the front surface 18 of body 12. A front face 49 on the transparent plate 46 is arranged for impacting a golf ball. Heel and toe ends 46*a* and 46*b* of transparent plate 46 are located adjacent heel and toe ends 20 and 22, respectively, of body 12.

Figure 4:
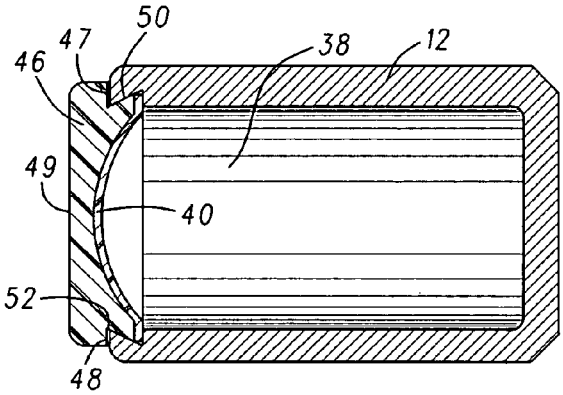
FIG. 4 is an enlarged sectional view taken along line 4-4 in FIG. 3.

Referring to FIG. 4, transparent plate 46 may be adhesively bonded to body 12; however, in the preferred embodiment, it is retained by conventional means such as a mechanical interlock or a snap fit between an inwardly extending recess 50 formed in front surface 18 of body 12 and an outwardly projecting flange 52 formed on rear surface 47 of transparent plate 46. As shown in FIG. 4, the snap fit between body 12 and transparent plate 46 encloses ball alignment indicia 40 therebetween. The transparent plate 46 has a partial spheroid shaped cavity 51 that receives the partial spheroid shape 42 of the ball alignment indicia 40. Also as shown in FIG. 4, cavity 38 occupies a majority of body rear portion 24 thereby maximizing the moment of inertia of club head 10 about its vertical axis.

Figure 5:
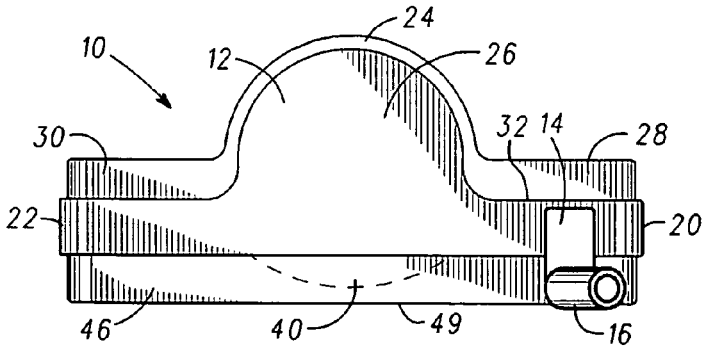
FIG. 5 is a top view of the golf club head shown in FIG. 3.

As shown in FIG. 5, the combination of the upper surface 26 of rear portion 24 having the same apparent diameter as ball alignment indicia 40 creates the appearance of a golf ball embedded in club head 10 when viewed by a golfer addressing a golf ball. This combination provides a virtual golf ball protruding forwardly of the front surface 18 of the body 12 thereby enabling a golfer to properly line up the club head 10 with a golf ball for more consistent and accurate putts.

What is claimed is:

1. A golf putter head comprising:

a body having a heel end, a toe end, and a front surface;

ball alignment indicia attached to said body, said ball alignment indicia having a partial spheroid shape that protrudes forwardly of the front surface of said front wall;

a transparent plate mounted on said body covering said ball alignment indicia, said transparent plate having a rear surface in contact with the front surface of said body;

said transparent plate including a flange projecting outwardly on said rear surface; and said body including a recess extending inwardly in said front surface for receiving said flange thereby forming a mechanical interlock between said transparent plate and said body.

2. The golf putter head of claim 1, wherein:

said ball alignment indicia is located intermediate the heel and toe ends of said body.

3. The golf putter head of claim 1, wherein:

said transparent plate includes a partial spheroid shaped cavity which receives the partial spheroid shape of said ball alignment indicia.

4. A golf putter head comprising:

a body having a heel end, a toe end, and a front surface;

ball alignment indicia attached to said body, said ball alignment indicia having a partial spheroid shape that protrudes forwardly of the front surface of said front wall;

a transparent plate mounted on said body covering said ball alignment indicia, said transparent plate having a rear surface in contact with the front surface of said body;

said body having a partial spheroid shaped cavity formed therein; and said partial spheroid shaped cavity being closed by said ball alignment indicia.

5. A golf putter head comprising:

a body having a heel end, a toe end, and a front surface;

ball alignment indicia attached to said body, said ball alignment indicia having a partial spheroid shape that protrudes forwardly of the front surface of said front wall;

a transparent plate mounted on said body covering said ball alignment indicia, said transparent plate having a rear surface in contact with the front surface of said body; and said body including an oblate spheroidal outer surface extending rearwardly from the back surface of said body.

6. The golf putter head of claim 5, wherein:

the oblate spheroidal outer surface on said body has a spherical diameter that substantially matches the partial spheroid shape of said ball alignment indicia.

7. A golf club head comprising:

a body having a heel end, a toe end, and a front surface;

ball alignment indicia attached to said body and protruding forwardly of the front surface of said body;

a transparent plate mounted on said body enclosing said ball alignment indicia between said body and said transparent plate;

said transparent plate having a front face arranged for impacting a golf ball; and a flange on said transparent plate received in a recess in said body thereby forming a mechanical interlock between said transparent plate and said body.

8. The golf club head of claim 7, wherein said ball alignment indicia is located intermediate the heel and toe ends of said body.

9. The golf club head of claim 7, wherein said ball alignment indicia has a partial spheroid shape.

10. A golf club head comprising:

a body having a heel end, a toe end, and a front surface;

ball alignment indicia attached to said body and extending forwardly of the front surface of said body, said ball alignment indicia being located intermediate the heel and toe ends of said body and having a partial spheroid shape;

a transparent plate mounted on said body enclosing said ball alignment indicia between said body and said transparent plate, said transparent plate having a front face arranged for impacting a golf ball; and a flange on said transparent plate received in a recess in said body thereby forming a mechanical interlock between said transparent plate and said body.

* * * * *